United States Patent [19]

Doerner

[11] 4,013,258

[45] Mar. 22, 1977

[54] CHAIR CONTROL FOR TILTABLE CHAIRS

[76] Inventor: Frank Doerner, 138 Aberdeen Road, Kitchener, Ontario, Canada

[22] Filed: Apr. 6, 1976

[21] Appl. No.: 674,222

Related U.S. Application Data

[63] Continuation-in-part of Ser. No. 540,116, Jan. 10, 1976, abandoned.

[30] Foreign Application Priority Data

Dec. 24, 1974 Canada ..... 216923

[52] U.S. Cl. ..... 248/381; 297/303

[51] Int. Cl.[2] ..... A45D 19/04

[58] Field of Search ..... 248/378–381; 297/301–305, 325, 326

[56] References Cited

UNITED STATES PATENTS

| | | | |
|---|---|---|---|
| 374,970 | 12/1887 | Kenna | 248/381 |
| 908,730 | 1/1909 | Bolens | 248/380 |
| 1,229,214 | 6/1917 | Bolens | 248/380 |
| 3,356,414 | 12/1967 | Doerner | 297/305 X |
| 3,368,844 | 2/1968 | Doerner | 297/303 |

*Primary Examiner*—Lawrence J. Staab
*Attorney, Agent, or Firm*—George H. Riches and Associates

[57] ABSTRACT

This invention discloses a novel and improved chair control for tilting chairs wherein the mechanism which controls the tilting of the chair is simplified and strengthened. It utilizes a bolt having an elongated head of V-shaped cross-section as the biasing means between the seat portion and the moveable frame portion. Stopping means are provided which reduce the pressure applied to the frame portions when the seat returns to a resting position, the means comprising a series of vertical and horizontal surfaces on each vertical side wall of the fixed frame portion which contact the moveable frame portion. Also provided is an improved feature to strengthen the control whereby the inner plate of the fixed frame portion has a pair of downturned spaced apart feet inserted through the base plate of the fixed frame portion to strengthen the control when the seat is tilted rearwardly.

2 Claims, 8 Drawing Figures

CHAIR CONTROL FOR TILTABLE CHAIRS

CROSS-REFERENCES TO RELATED APPLICATIONS

This application is a continuation-in-part of my U.S. patent application Ser. No. 540,116 filed on January 10, 1975, now abandoned.

BACKGROUND OF THE INVENTION

This invention relates generally to chairs and more particularly, to a chair control for tilting chairs.

In the past, mechanisms which controlled the tilting of a tiltable chair have comprised a fixed base, a support post, a fixed frame portion and a moveable frame portion attached to the seat of the chair. The fixed frame portion and the moveable frame portion were pivotally interconnected so that the seat of the chair could be pivoted in a horizontal plane and also be pivoted in a vertical plane. The fixed base contained a support post and was affixed to a set of outwardly extending legs and the upper portion of the support post was screw-threaded which provided a means to adjust the height of the seat of the chair.

The fixed frame portion was affixed to the uppermost part of the support post and a means was provided for interconnecting the fixed frame portion to the moveable frame portion which was attached to the seat of the chair. The moveable frame portion is pivoted about the means and a stopping mechanism was provided to restrict the pivotal movement of the seat.

The means employed in the prior art about which the seat portion and the moveable frame portion pivoted have comprised many different biasing means. Some have included coil springs, flat springs, tension bars and leaf springs. These various devices have proved complicated to manufacture and rather expensive to produce and have not provided a smooth pivot point.

A further disadvantage exhibited by the controls of the prior art is the lack of an efficient and strong stopping means to arrest the movement of the seat of the chair when the chair is tilted backwards and then released to return to the forward position.

The fixed frame portions of the controls of the prior art have shown a tendency to weaken and break after repeated use. This has been found attributable to the constant pressure and pull on the inner plate of the fixed frame portion by the head of the biasing means when the control is in use. This pressure is exerted in the forward and upward directions by the pivoting of the head of the biasing means which tends to pull the inner plate away from the base plate of the fixed frame portion.

SUMMARY OF THE INVENTION

Accordingly, it is an object of the present invention to overcome some of these and other disadvantages by providing a chair control with a tilting and biasing mechanism which is efficient and relatively inexpensive to manufacture.

Another object of the present invention is to provide a stopping means which will withstand the constant pressure applied thereto and which removes the pressure from the arms of the moveable frame portion of the chair control.

Yet another object of the present invention is to provide a chair control wherein the moveable frame portion and the fixed frame portion are interconnected by a simple and efficient means which allows the moveable frame portion to pivot thereabout.

A further object of the present invention is to provide a strengthened fixed frame portion of a chair control which demonstrates increased stability and which will not break after repeated use and which also is relatively inexpensive to manufacture.

To this end, in one of its aspects, the invention provides a chair control for a tilting chair comprised of a first frame member mountable in a fixed position on a post, a co-operating second frame member pivotally connected to the first frame member and attachable to the under surface of a chair seat, biasing means connecting the first and second frame members adapted to return the chair seat to a substantially horizontal position of rest after it has been tilted backwards.

In another of its aspects, the invention further provides a biasing means for pivotally connecting the first frame member to the second frame member which consists essentially of a bolt having at one end an elongated head of V-shaped cross-section with the point of the vee pointing towards the other end of the bolt and which is inserted through the first and second frame members and pivots in a corresponding slot in the first frame member when the seat of the chair is urged in a backwards and tilted position.

In another aspect of this invention, there is disclosed a novel fixed frame portion comprising an inner plate and a base plate, the inner plate having a pair of downturned spaced apart feet forming a slot therebetween through which the biasing bolt means is inserted, the feet extending through a pair of corresponding slots in the base plate of the fixed frame portion thereby strengthening the connection between the fixed frame portion and the moveable frame portion and also eliminating a welding step in the process of manufacture.

In yet another one of its aspects, the invention provides a novel and improved stopping means which comprises a horizontal surface and an adjacent vertical surface on the fixed frame portion corresponding to a horizontal surface and an adjacent surface when the seat is in a resting position, both surfaces on the moveable frame portion rest on the surfaces of the moveable frame portion thus preventing the seat of the chair from pivoting further. A rearwardly sloping surface on the fixed frame portion and a corresponding sloping surface of the moveable frame portion provides the stopping means as the seat of the chair is tilted backwards.

BRIEF DESCRIPTION OF THE DRAWINGS

Further objects and advantages of the invention will appear from the following description taken together with the accompanying drawings in which.

Figure 5:
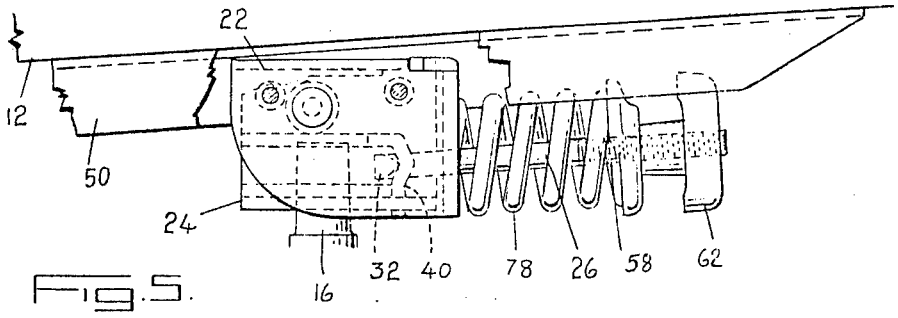
Figure 6:
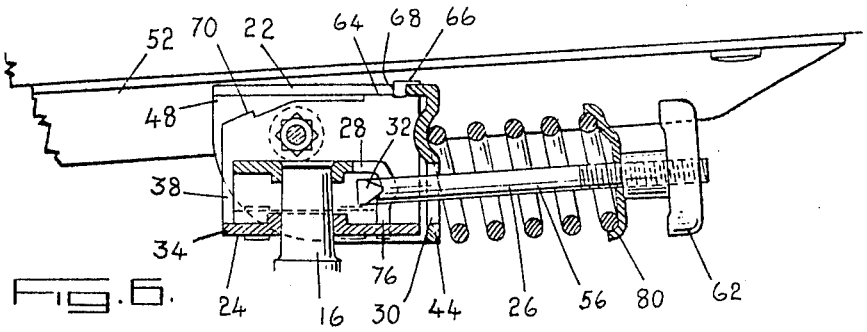
Figure 7:
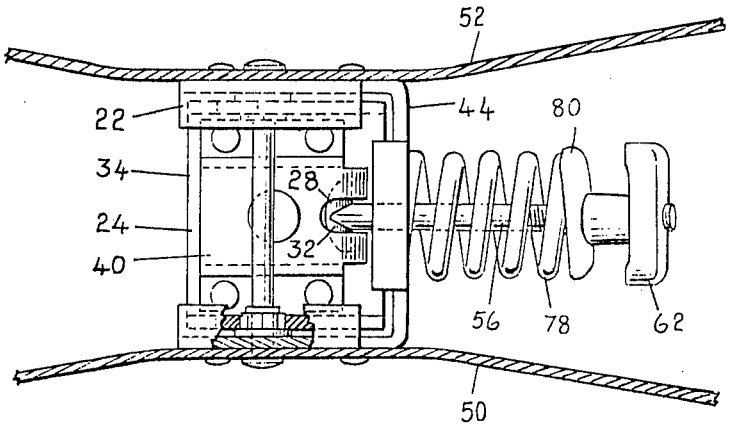

FIG. **4*a*** is a perspective view of a preferred embodiment of the fixed frame portion of the chair control of the present invention;

FIG. 5 is a side view of the chair control of the present invention;

FIG. 6 is a cross-sectional side view of FIG. 5;

FIG. 7 is a top view of a chair control of the present invention.

DETAILED DESCRIPTION OF THE DRAWINGS

Figure 1:
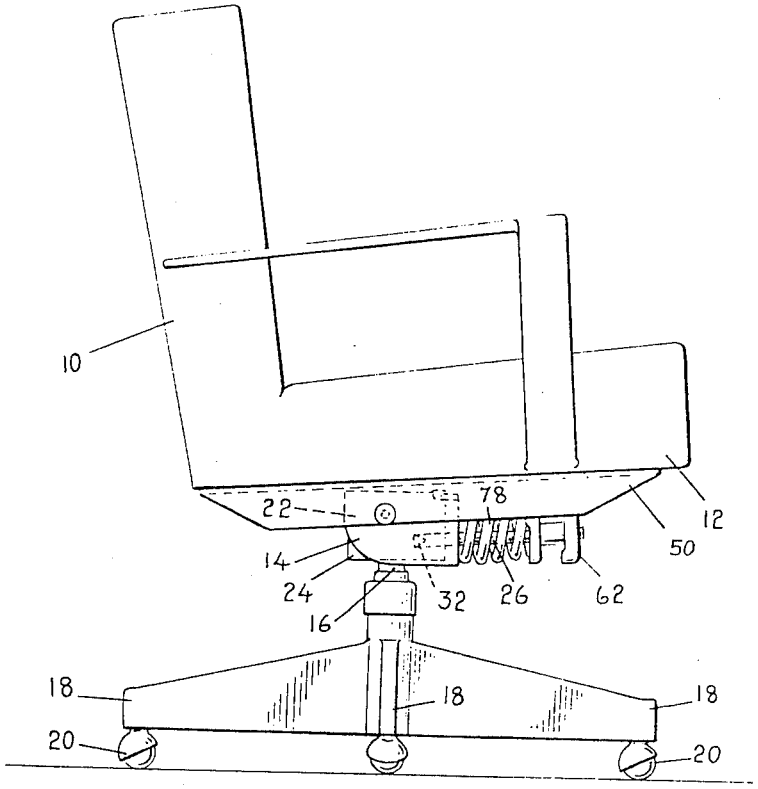
FIG. 1 is a side view of a tilter chair.

Reference is first made to FIG. 1 which shows a tilter chair generally comprising a back 10, a seat 12, a chair control 14 which allows and controls the tilting and the swivelling of the seat 12 in a horizontal and also in a vertical plane. The chair control 14 is mounted on a support post 16 which is connected to the legs 18 of the chair which may be mounted on casters 20.

The chair control of the present invention consists generally of a moveable frame portion 22 affixed to the seat 12 and a fixed frame portion 24 mounted on the support post 16. The two frame portions 22 and 24 are pivotally interconnected by a bolt 26 which may be inserted through a first opening 28 in the fixed frame portion 24 and then through a second opening 30 in the moveable frame portion 22.

The fixed frame portion 24 is carried on the support post 16 while the moveable frame portion 22 is rigidly fixed to the seat 12. The moveable frame portion 22 is pivotally connected to the fixed frame portion 24 by the components which will hereafter be described in relation to the invention of the present application.

The fixed frame portion comprises a base plate 34 with a pair of upright arms 36 and 38 formed integrally therewith thus forming a U-shaped frame. The fixed frame portion 24 carries an inner plate 40 disposed above and connected to said base plate 34 with a circular opening 42 in its centre through which the upper end of the support post 16 is fitted thus rigidly fixing the fixed frame portion 24 to the support post 16. The fixed frame portion may revolve in a horizontal plane about the support post 16.

The moveable frame portion 22 is generally U-shaped having a base plate 44 and two outwardly extending arms 46 and 48. As shown in FIGS. 5 to 7, the moveable frame portion 22 fits outside the fixed frame portion so that base plate 34 is normal to base plate 44. Moveable frame portion 22 carries two elongated brackets 50 and 52 which are secured to the seat 12.

The inner plate 40 of the fixed frame portion has a first opening 28 which corresponds in position to a second opening 30 in the fixed frame portion. The leading edge of the inner plate 40 is V-shaped with the preferred angle at the base of the vee being approximately 120°.

Figure 2:
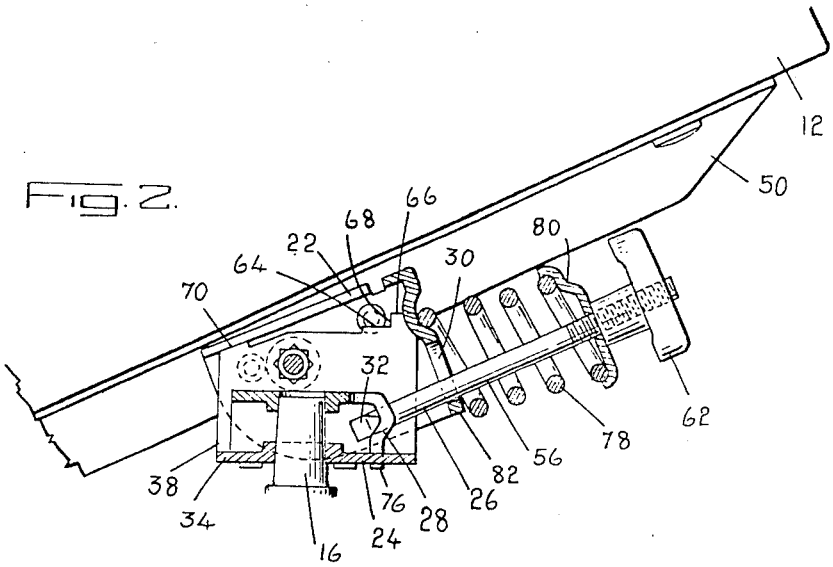
FIG. 2 is an enlarged side view partly in cross-section of the chair control of the present invention.
Figure 3:
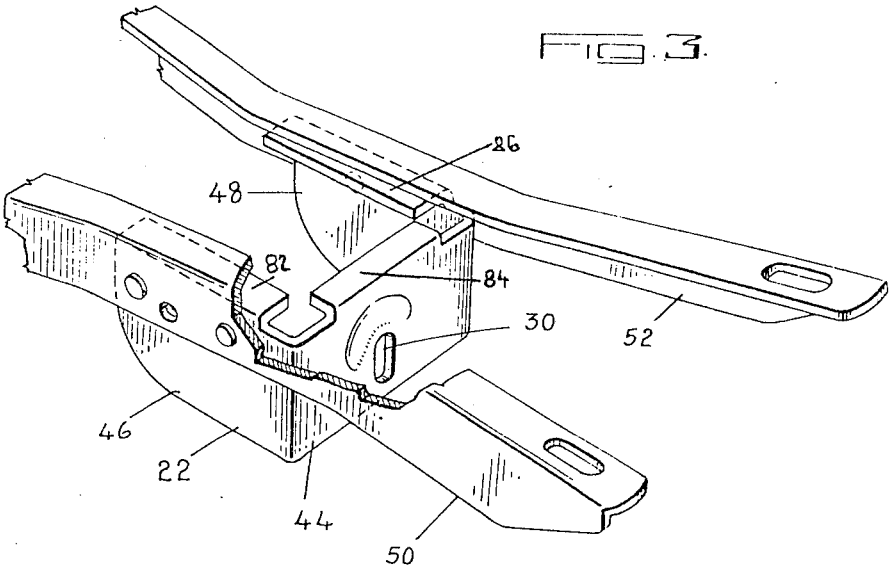
FIG. 3 is a perspective view of the moveable frame portion with one arm partially cut away of a chair control of the present invention.

The bolt 26 has a V-shaped cross-sectional bolt head 32 and the preferred angle of the base of the vee approximates 60° and an elongated shaft 56 centrally at the base of the vee with a threaded end portion 58. As shown in FIG. 2, the bolt 26 may be inserted from the inside of the inner plate 40 extending through the first opening 28 and through the second opening 30 of the moveable frame portion. The bolt head 32 is seated in the V-shaped leading edge of the inner plate 40 and thus can pivot on the point of the vee as the seat 12 of the chair is pivoted backwards. This provides a pivotal connection between the fixed frame portion 24 and the moveable frame portion 22.

Figure 4:
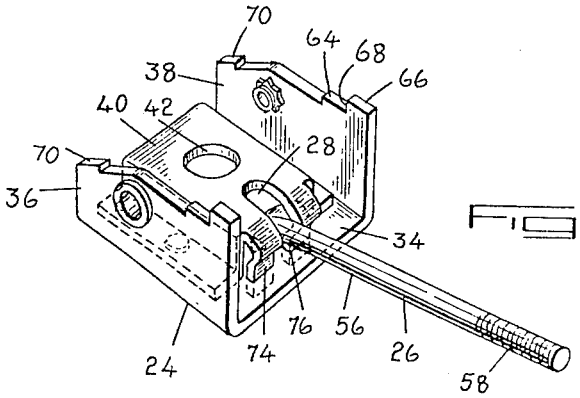
FIG. 4 is a perspective view of the fixed frame portion of a chair control of the present invention.
Figure 4A:
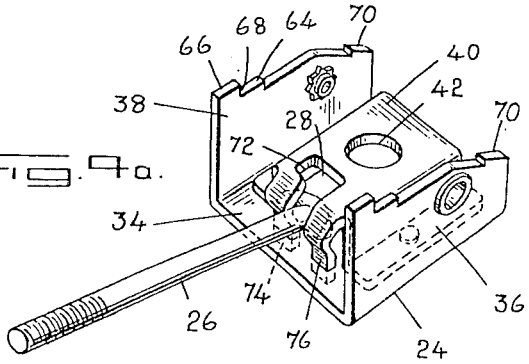

The bolt may also be inserted by inserting the shaft of the bolt through the second opening 30 from the inside of the moveable frame portion and then by inserting the bolt head 32 through an enlarged first opening 72 of the fixed frame portion (see FIG. 4*a*). In this embodiment, the necessity of inserting the bolt from the inside of the inner plate 40 is removed and the bolt may be inserted easily from the outside of the plate 40. After inserting, the head of the bolt 32 is fitted in the V-shaped leading edge of the inner plate 40.

A helical spring 78 is inserted onto the shaft 56 of the bolt 26 and an adjustable handle 62 is threaded thereon.

The pivotal connection comprising the bolt with a V-shaped bolt head provides a much improved and simplified mechanism than disclosed by the prior art. This bolt removes the necessity of providing pivot rods or other mechanisms about which the frame pivots.

As shown in FIG. 4, the upper surfaces of the upright arms 36 and 38 of the fixed frame portion 24 appear as a step pattern rising towards the leading edge of the portion. The first surface 64, second surface 66 and third surface 68 provides an improved stopping means for the chair control. After the chair has been tilted rearwards as shown in FIG. 2 and released, the moveable frame portion 22 contacts the fixed frame portion 24 on the surfaces 64 and 68 respectively, as shown in FIG. 6. Once this contact is made, the moveable frame portion and the seat of the chair are prevented from moving further forward.

The particular advantage of this mechanism is that two surfaces are provided to stop the movement of the seat of the chair. Consequently, the pressure applied to each individual surface is reduced and the control will not only be more durable but can also be made of a lighter material.

Similarly, when the chair is tilted in a rearward direction, the moveable frame portion is engaged with the surface 70 as shown in FIG. 2. The angle through which the seat may pivot is controlled by not only the ability of the bolt head 32 to pivot in the slot provided but also the angle of the surface 70.

The chair controls of the prior art generally only provided a single surface to receive the pressure and the weight of the seat of the chair when it returned to the resting position. It was therefore required for that surface to be made of rather heavy materials and to be reinforced. The present invention provides a safe and reliable as well as economical stopping means.

In order to further strengthen the operation of the chair control of the present invention, there are provided on the inner plate 40, two downturned spaced apart feet 74 and 76 which correspond with two slots in the front portion of the base plate 34 of the fixed frame portion. Thus, as the head of the bolt 32 pivots in the corresponding slot in the inner plate 40, part of the strain is taken up by the feet 74 and 76 thus relieving some of the tension on the inner plate 40.

One of the problems with the controls of the prior art is that upon repeated use, an upward and forward pressure is applied to the inner plate of the fixed frame portion which tends to pull this plate away from the base plate and therefore causing the mechanism to breakdown.

In the present invention, this problem has been eliminated by inserting the downturned spaced apart feet 74 and 76 in corresponding slots in the base plate of the fixed frame portion. As seen in FIGS. 5 and 6, as the chair is tilted rearward, the head of the bolt 32 pivots in the slot created by the downturned spaced apart feet 74 and 76. FIG. 2 shows the position of the bolt when the chair is tilted rearward. In this position, there is a substantial force exerted by the bolt head 32 in an upward and forward direction which tends to pull the forward part of the inner plate away from the base plate. It has been found that welding the forward part of the inner plate to the base plate, in addition to being a time consuming and expensive procedure, does not provide the necessary strength to prevent the inner plate from being pulled away from the base plate after repeated use. However, by inserting the spaced apart feet through the base plate, sufficient strength is added to the construction of the fixed frame portion to prevent the inner plate from being pulled away from the base plate. The directions of this force during operation is not vertical but in a forward and upward direction. Thus, by inserting the ends of the feet through the base plate, a much larger area of contact is provided which utilizes the strength of the material of the base plate to prevent any breakage and to resist the upward and forward force exerted on the inner plate during the rearward tilting of the chair seat. Rather than depending only on the strength of a weld point, this mechanism utilizes the inherent strength of the base plate in conjunction with the strength of the feet inserted therethrough.

The construction of this fixed frame portion has also been simplified. The holes in the base plate may be punched out during manufacture and the pair of feet inserted through these holes in a simplified manner. No welding is necessary which eliminates a step in the production process.

The chair control of the present invention may also carry a pressure plate 82 removably carried by the moveable frame portion against which the helical spring 78 is tightened by turning the adjustable handle 62. A second pressure plate 80 may be inserted between the spring 78 and the handle 64 which allows an easier tightening process and removes some of the pressure of the spring 78 directly on the moveable frame portion and the handle 62.

Although the disclosure describes and illustrates a preferred embodiment of the invention, it is to be understood the invention is not restricted to this particular embodiment.

I claim:

1. A chair control for a tilting chair which comprises a first frame member mountable in a fixed position on a chair post, said first frame member consisting of a base plate and a pair of upwardly extending arms formed integrally therewith, a co-operating second frame member pivotally connected to said first frame member and attachable to the undersurface of a chair seat, biasing means connecting the first and second frame members and adapted to return said chair seat to a substantially horizontal position of rest after it has been tilted backwards, said biasing means consisting essentially of a bolt having a shaft and at one end an elongated head of vee shaped cross-section with the point of the vee pointed towards the other end of the bolt, said first frame member having an inner plate with a pair of spaced apart feet forming a slot therebetween, said bolt projecting through said slot extending forwardly and downwardly from the front of said inner plate to form between said feet with the point of the vee pivoting on the inner surface of the legs, a pressure plate secured to the second frame member and having rotative movement about a horizontal axis and a spring mounted on said shaft of said bolt and having one end seated on said pressure plate and the other end seated on a second plate and spring tightening means on said shaft, said pair of spaced apart feet extending through a pair of corresponding slots in said base plate of said first frame member.

2. In a chair control for a tilting chair which comprises a fixed first frame member mounted in a fixed position on a chair post, a co-operating second frame member pivotally connected to said first frame member and attachable to the undersurface of a chair seat, biasing means connecting the first and second frame members and adapted to return said chair seat to a substantially horizontal position of rest after the chair seat has been tilted backwards, said biasing means consisting essentially of a bolt having at one end, an elongated head of vee shaped cross-section with the vee pointing towards the other end of the bolt, the improvement comprising said first frame member consisting of a base plate with a pair of upwardly extending arms formed integrally therewith, and an inner plate with a pair of spaced apart feet extending forwardly and downwardly from the front of said inner plate to form a slot therebetween, said bolt projecting through said slot formed between said feet with the point of the vee pivoting on the inner surface of the legs, and the ends of the pair of spaced apart feet extending downward through a pair of corresponding slots in said base plate of said first frame member.

* * * * *